United States Patent [19]

Hohenfeld

[11] Patent Number: 4,914,864

[45] Date of Patent: Apr. 10, 1990

[54] FIRE DOORS AND METHOD OF LOCATING FIRE HOSE

[76] Inventor: Jeffrey A. Hohenfeld, 13296 Jacque Rd., Strongsville, Ohio 44136

[21] Appl. No.: 243,980

[22] Filed: Sep. 13, 1988

[51] Int. Cl.[4] ..... E06B 3/00

[52] U.S. Cl. ..... 49/506; 49/170

[58] Field of Search ..... 49/170, 169, 163, 48, 49/171, 70, 506; 160/180

[56] References Cited

U.S. PATENT DOCUMENTS 1,186,566 6/1916 Fogg ..... 49/169
2,315,365 3/1943 Christy ..... 49/169
4,754,797 7/1988 Sronce ..... 49/169 X
4,760,872 8/1988 Hale, Jr. ..... 160/180 X

FOREIGN PATENT DOCUMENTS 68768 9/1969 German Democratic Rep. ... 49/170

*Primary Examiner*—Philip C. Kannan
*Attorney, Agent, or Firm*—J. Helen Slough

[57] ABSTRACT

A fire door having a hatch disposed in the lowermost outer corner of the same adapted to swing open to provide sufficient space for the passage of fire hose through the door, the hatch being a minor portion of the door whereby the major portion of the door can be kept closed after the placement of hose through the door.

1 Claim, 2 Drawing Sheets

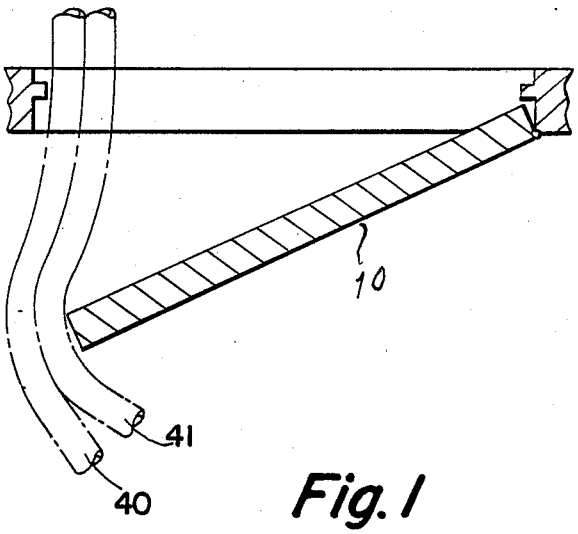
Fig. 1
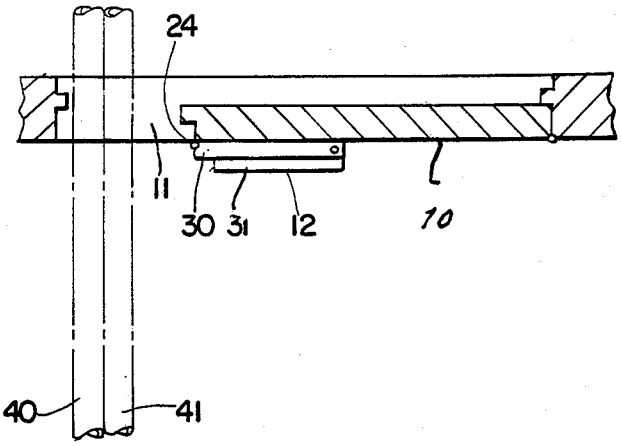
Fig. 2
Fig. 3
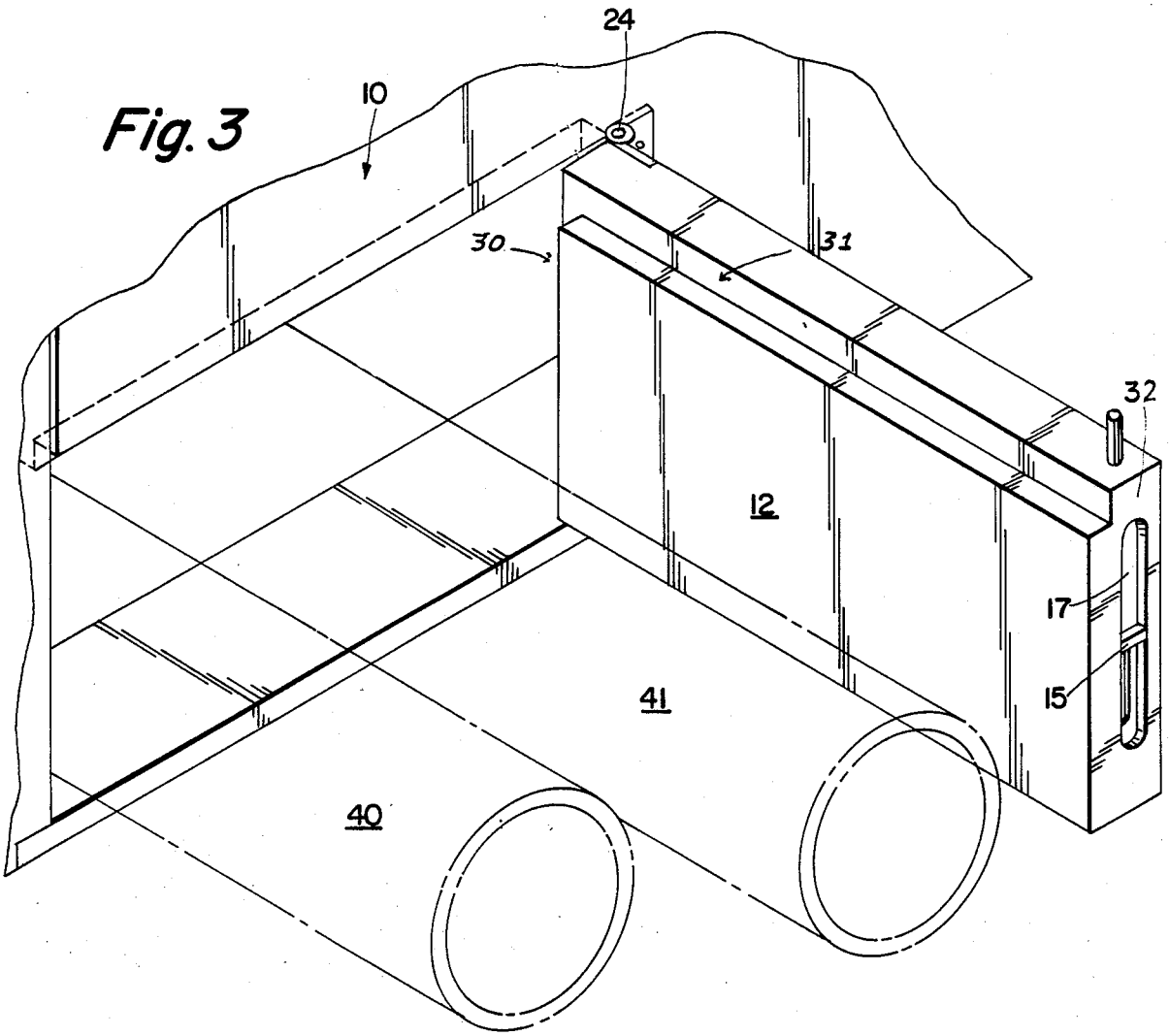

FIRE DOORS AND METHOD OF LOCATING FIRE HOSE

BACKGROUND OF THE INVENTION

In fighting structure fires, hose lines are commonlylaid along the means of egress for occupants of the building and passed through doorways. Normally, in high rise buildings the standpipe hose outlet is located in the stairwells which serve as means of egress for the occupants of the building during a fire. The fire hose is connected to the standpipe (which serves as its water supply) and must be laid through a doorway (normally a fire door) to the fire floor. As a result, the fire door which is designed to keep the staircase free of heat and smoke by containing the fire on the fire floor, is necessarily propped open hence defeating its intended purpose and allowing the means of egress, especially the floors above the fire floor, to be flooded with heat and smoke.

In the past various proposals have been made to solve this problem, for example, relocating the hose outlet from the stairwell side of the fire door to the other side of the same, normally in a main hallway just inside the fire door. This solution, however, poses other problems. One such problem is that the fire fighter must now enter the fire area without a charged fire hose. This normally is not considered a safe practice, even if it is feasible in a particular situation. In many situations this may not be feasible because the fire area (the area on the fire side of the fire door) may be so charged with heat and smoke as to make locating and connecting to the standpipe hose outlet difficult if not impossible. The solution to this problem normally would be to use the standpipe hose outlet on the floor below the fire floor (in a high rise stairwell) and then lay the hose up one flight of stairs and through the fire door to the fire. This solution has the effect of causing two fire doors to be propped open with potentially unfortunate results.

Another proposed solution to the problem of entering the fire floor with a connected hose line without compromising the means of egress, is to install a second fire door near the first one. The hose outlet could be located in the vestibule that would be created between the two doors. This solution, however, has two major disadvantages. The first and most obvious is the cost. Hose outlets would still have to be relocated from the stairwell landing to the hallway (in the case of existing structures) and in addition, a second fire door would have to be installed adjacent to each hose outlet. This, of course, would be an inconvenience during normal everyday use, since occupants then would open two doors rather than just one. The second disadvantage is the small work space fire fighters would have in such a hallway/vestibule when connecting hoses to the standpipes. Fire fighters would still be unable to charge the hose line before entering the fire floor (through the second door) due to the very limited space. If fire fighters felt it was necessary to charge the hose before entering, they would have to pass it through the first fire door into the stairwell and then back through the door again, into the vestibule, and through the second doorway. This, of course, would result in propping open both doors and defeat the purpose of the second door.

SUMMARY OF THE INVENTION

A primary object of the present invention is to minimize or eliminate all of the problems referred to above.

Another object of the invention is to provide an improved fire door wherein means are provided therein to effectively reduce or block the spread of smoke and fire and to control the same to free egress for occupants from the building.

A further object is to provide means associated with the fire door whereby a fire hose can pass through a selected portion only of the fire door and still permit the door to close, or the major portion thereof to remain closed.

Still another object of my invention is to provide a fire door having the above improvements therein which improvements are inexpensive to manufacture and highly efficient in use.

Other objects of the invention and the invention itself will become more apparent from a study of the following specification when viewed in light of the accompanying drawings, in which:

DESCRIPTION OF THE DRAWINGS

FIG. 1 is an elongated sectional view of position of a fire door in open position showing fire hose passing therethrough;

FIG. 2 is a view similar to that of FIG. 1 showing the fire door closed and the hatch of the invention in open position;

FIG. 3 is a perspective view of a first embodiment of the door hatch of my invention shown in open position with fire door in closed position and shows hose projecting therethrough;

Figure 4:
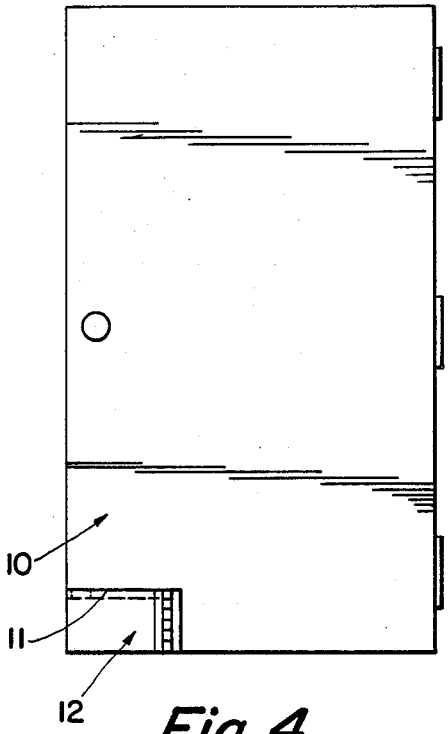
FIG. 4 is a front elevational view of the fire door and hatch of the invention shown in FIGS. 1 to 3 inclusive.
Figure 5:
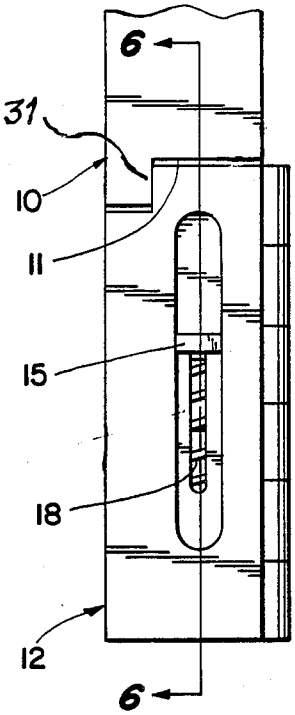
FIG. 5 is an enlarged view of the hatch having the same secured to a major portion of the door.
Figure 6:
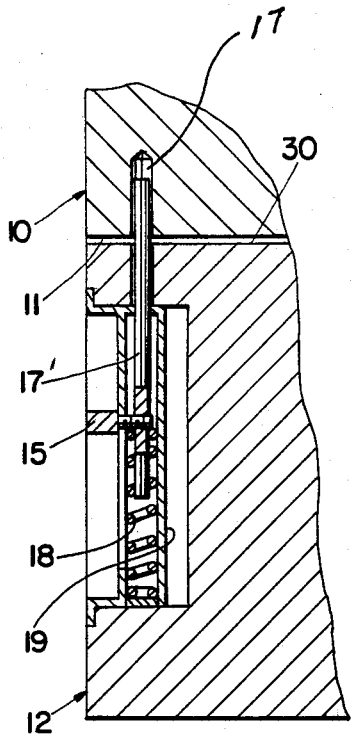
FIG. 6 a view partly in section taken from the line 6—6 of FIG. 5.
Figure 7:
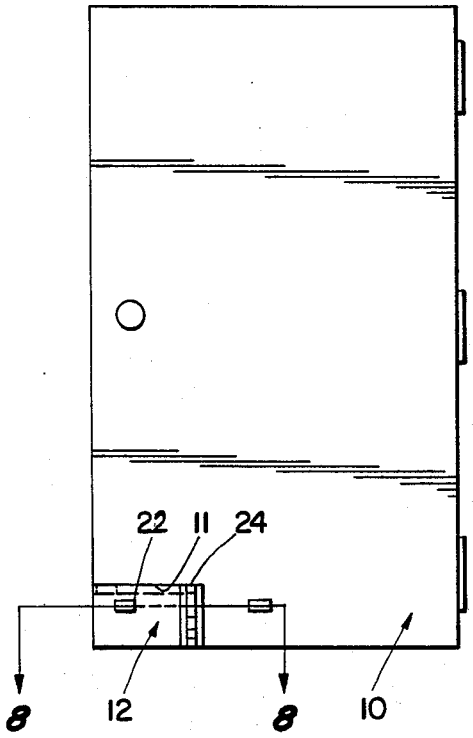
FIG. 7 is a view similar to that of FIG. 4 showing a second embodiment of my invention.
Figure 8:
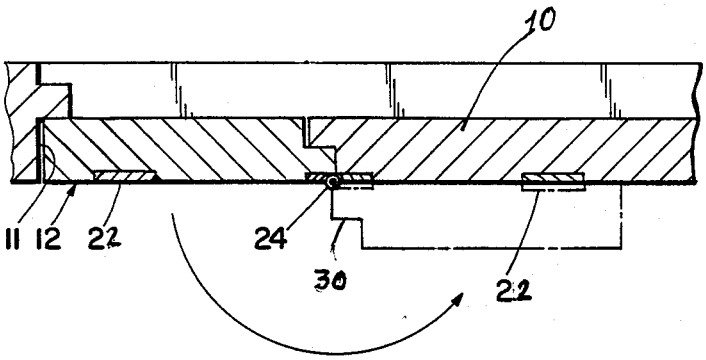
FIG. 8 is an enlarged sectional view of the embodiment of FIG. 7.

Referring now to the drawings, in all of which like parts are designated by like reference characters, and referring more particularly to the embodiment shown in FIGS. 2 to 6 inclusive, at 10 I show a fire door having a cut-away lower outermost corner or as shown, a substantially rectangular opening 11 at the lower corner side of the door in which a hatch or gate 12, of preferably the fire door material of the door to which it is attached, is mounted. The hatch as shown is adapted to be opened manually towards the means of egress of the door to insert hose therethrough as more fully related hereinafter and shown in FIG. 3. The hatch 12 is, as shown in FIGS. 3 to 6 inclusive, provided with jambs 30, 31 which contact and fit into the fire door in order to secure a good seal against the passage of heat and smoke when the door is in closed position. Hinges 24 as illustrated are provided on the jamb 30 to hinge the hatch to the inner side of the cut-away portion of the door to provide swinging movement of the hatch in the same direction as the door in which it is located. The hatch could also be designed to swing open in a direction opposite that of the fire door. A slide bolt latch 15 in the form of FIGS. 3, 5 and 6, is recessed as shown into the outside edge 32 of the hose hatch 12, opposite the door hinge and is adapted to be slid into a notch or recess 17 in the portion of the fire door 10 immediately above the hatch to hold the hatch in closed position with the fire door. To open the hatch, since the slide bolt is recessed within an outside edge of the door, the latch 15 which is shown spring pressed by a coil spring 18 located below the bolt 17' in a tubular body 19 disposed in the edge 32 can only be opened when the fire door is opened first. This latching method preferably is used on a fire door in a location where security is a consideration since as stated the latch cannot be opened without first opening the fire door. However, in order for the hose hatch to have maximum utility, other means of holding the hose hatch closed may be employed. For example, latching mechanisms such as magnets, pinch rollers or velcro could be placed on opposing surfaces or spring closures could be used on the hinge 24 (see FIGS. 7 and 8). Such alternate latching mechanisms may also be used to hold the hose hatch in the open position when properly placed (see reference numeral 22, FIGS. 7 and 8). A spring loaded hinge may also be used to hold the host hatch open especially when used with slide bolt 15.

When two hoses, for example 2-½" hoses 40 and 41, are passed through a doorway fitted with a standard fire door of the dimensions shown, the door is propped open to allow an opening through which heat and smoke may pass (see FIG. 1). With the hose hatch of this invention in use only a small opening would result (see FIG. 2) and the same effects a large reduction in the size of the opening. When fire hoses are laid straight through a doorway and not laid at an angle to minimize the opening, a much larger area is exposed. Use of the hose hatch as in FIGS. 2 and 3 minimizes the size of this opening. It is important to note that a great reduction of the passage of heat and smoke results over that which would result from opening a fire door constructed in the conventional full door manner. The small opening that remains when the hatch is opened is only a short distance from the floor, where the least amount of heat and smoke occurs.

The use of fire doors equipped with the hose hatch of this invention permits fire doors to be closed which would otherwise be propped open by hoses inserted therethrough. Fire suppression is accomplished in a faster and safer manner than prior hereto because the tactical problems described hereinbefore are eliminated. Also the need for fire fighters to make a hose connection on the fire side of a fire door is eliminated, but the fire door can still be kept closed with the exception of the minor portion of the door providing the hatch portion, therein allowing the fire door to function as intended. As a result, the spread of smoke and fire is better controlled, especially to the means of egress, allowing more time for occupants to escape and greatly reducing smoke damage. The hose hatch of this invention further reduces building and maintenance costs by eliminating the need for a second fire door or the relocation of hose outlets.

While I have described my invention in connection with preferred embodiments, I am aware that numerous and extensive departures may be made therefrom without however departing from the spirit of my invention or the scope of the appended claims.

What I claim is:

1. The method of laying fire hose through a fire door which comprises opening the fire door, laying hose through the doorway, placing the hose adjacent the outermost portions of the door, closing the door, the hose passage limited to passage through a lowermost outer opening in the door.

* * * * *